US010138588B1

(12) United States Patent
Foy, Jr.

(10) Patent No.: US 10,138,588 B1
(45) Date of Patent: Nov. 27, 2018

(54) CLOTHES DRYER VENTILATION SYSTEM

(71) Applicant: Dock Foy, Jr., Baltimore, MD (US)

(72) Inventor: Dock Foy, Jr., Baltimore, MD (US)

( * ) Notice: Subject to any disclaimer, the term of this patent is extended or adjusted under 35 U.S.C. 154(b) by 276 days.

(21) Appl. No.: 15/175,200

(22) Filed: Jun. 7, 2016

(51) Int. Cl.
*D06F 58/22* (2006.01)

(52) U.S. Cl.
CPC ..... *D06F 58/22* (2013.01)

(58) Field of Classification Search
CPC ..... D06F 58/20; D06F 58/22
USPC ..... 34/82, 86
See application file for complete search history.

(56) References Cited

U.S. PATENT DOCUMENTS 3,716,925 A * 2/1973 Hartung ..... D06F 58/20 34/235
4,034,482 A 7/1977 Briscoe
4,106,213 A 8/1978 Witte
4,122,612 A * 10/1978 Mrofchak ..... D06F 58/20 137/875
4,137,647 A 2/1979 Clark, Jr.
4,156,973 A * 6/1979 Bede ..... D06F 58/20 137/875
4,227,315 A 10/1980 Hight
D258,609 S 3/1981 Vogt
4,348,818 A 9/1982 Brown
4,388,766 A * 6/1983 Sanderson ..... D06F 58/20 137/865
4,395,831 A * 8/1983 Nielsen ..... D06F 58/20 34/235
4,434,564 A * 3/1984 Braggins, Jr. ..... D06F 58/20 34/235
D283,247 S * 4/1986 Margiloff ..... D23/343
4,969,276 A * 11/1990 Walsh ..... D06F 58/20 34/235
5,210,960 A * 5/1993 LaRue ..... D06F 58/22 34/235
5,675,908 A * 10/1997 Barnes ..... D06F 58/22 34/235
6,189,228 B1 * 2/2001 Schuette ..... D06F 58/20 34/235
7,213,349 B1 * 5/2007 Brunner ..... D06F 58/20 34/86
8,240,064 B2 * 8/2012 Steffens ..... D06F 58/22 34/210
8,893,399 B2 * 11/2014 Gregory ..... F26B 25/007 34/381
2011/0092150 A1 4/2011 Morier

FOREIGN PATENT DOCUMENTS

DE 102008044284 A1 * 6/2010 ..... D06F 58/206
DE 2194183 A3 * 9/2010 ..... D06F 58/206

* cited by examiner

*Primary Examiner* — Stephen M Gravini
(74) *Attorney, Agent, or Firm* — Kyle A. Fletcher, Esq.

(57) ABSTRACT

The clothes dryer ventilation system is adapted for use with a dryer. The clothes dryer ventilation system is a duct with a damper that routes the exhaust air discharged from a dryer to either 1) an exhaust vent leading out of the building the dryer is located in; or, 2) a recirculation vent that directs the discharged exhaust air into the interior of the building the dryer is located in. The clothes dryer ventilation system further comprises a filter assembly that filters the discharged exhaust air before release. The clothes dryer ventilation system comprises a master duct, a damper, a filter assembly, and a vent.

11 Claims, 2 Drawing Sheets

CLOTHES DRYER VENTILATION SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of heating and ventilation, more specifically, ductwork adapted for use with dryers that filters and redirects air flow from a dryer.

SUMMARY OF INVENTION

The clothes dryer ventilation system is adapted for use with a dryer. The clothes dryer ventilation system is a duct with a damper that routes the exhaust air discharged from a dryer to either 1) an exhaust vent leading out of the building the dryer is located in; or, 2) a recirculation vent that directs the discharged exhaust air into the interior of the building the dryer is located in. By discharging exhaust air into the building the dryer is located in the clothes dryer ventilation system reuses the waste heat and humidity contained within the discharged exhaust air so that the discharged exhaust air can be reused to condition the air within the interior of the building the dryer is located in. The clothes dryer ventilation system also comprises a filter unit that filters the discharged exhaust air before release.

These together with additional objects, features and advantages of the clothes dryer ventilation system will be readily apparent to those of ordinary skill in the art upon reading the following detailed description of the presently preferred, but nonetheless illustrative, embodiments when taken in conjunction with the accompanying drawings.

In this respect, before explaining the current embodiments of the clothes dryer ventilation system in detail, it is to be understood that the clothes dryer ventilation system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the clothes dryer ventilation system.

It is therefore important that the claims be regarded as including such equivalent construction insofar as they do not depart from the spirit and scope of the clothes dryer ventilation system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
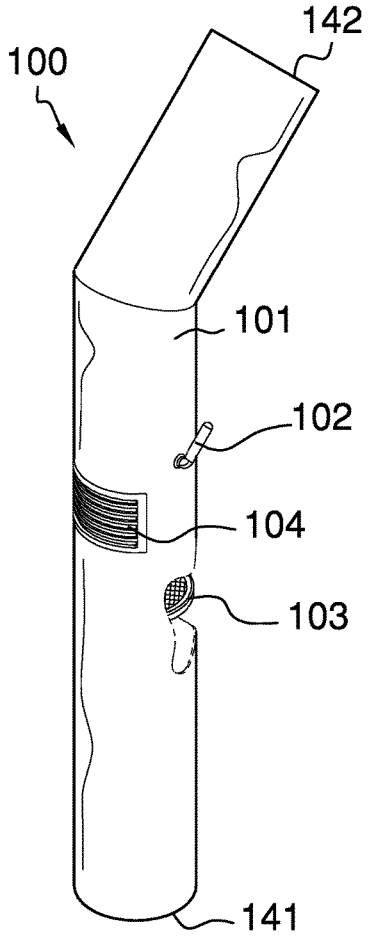
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The clothes dryer ventilation system 100 (hereinafter invention) comprises a master duct 101, a damper 102, a filter assembly 103, and a vent 104. The invention 100 is adapted for use with a clothes dryer 131 (hereinafter dryer). The invention 100 is a duct with a damper 102 that routes the exhaust air 133 discharged from the dryer 131 to either 1) an exhaust vent 132 leading out of the building the dryer 131 is located in; or, 2) a recirculation vent 104 (hereinafter vent) that directs the discharged exhaust air 133 into the interior of the building the dryer 131 is located in. By discharging exhaust air 133 into the building the dryer 131 is located in the invention 100 reuses the waste heat and humidity contained within the discharged exhaust air 133. The filter assembly 103 filters the discharged exhaust air 133 before release.

The master duct 101 is a tube that connects the dryer 131 to the exhaust vent 132. The master duct 101 is further defined with a first end 141, a second end 142, and a center axis 144. The first end 141 of the master duct 101 is attached to the dryer 131 and receives discharged exhaust air 133 from the dryer 131. The second end 142 of the master duct 101 is attached to the exhaust vent 132. The master duct 101 transports the discharged exhaust air 133 to its final destination.

The damper 102 is a valve that is mounted within the master duct 101. The purpose of the damper 102 is to control the flow of gas through the master duct 101. When the damper 102 is in an open mode, the flow of gas from the first end 141 of the master duct 101 to the second end 142 of the master duct 101 is unimpeded thus allowing the discharged exhaust air 133 from the dryer 131 to exit the building through the exhaust vent 132. When the damper 102 is in a closed mode, the flow of gas from the first end 141 of the master duct 101 to the second end 142 of the master duct 101 is blocked thus diverting the discharged exhaust air 133 from the dryer 131 to a vent 104 that is formed in the master duct 101. The vent 104 and the damper 102 are discussed elsewhere in this disclosure.

The damper 102 further comprises a baffle 111, a baffle mount 112, and a handle 113. As shown most clearly in FIGS. 2 and 4, the baffle 111 is a plate that mounted within the master duct 101. The baffle 111 is sized and shaped such that the baffle 111 blocks the flow of gas from the first end 141 of the master duct 101 to the second end 142 of the master duct 101. The baffle 111 is mounted within the master duct 101 using the baffle mount 112. The baffle mount 112 further comprises a first pivot 114 and a second pivot 115. The first pivot 114 and the second pivot 115 are each used to connect the baffle 111 to the side of the master duct 101.

Figure 2:
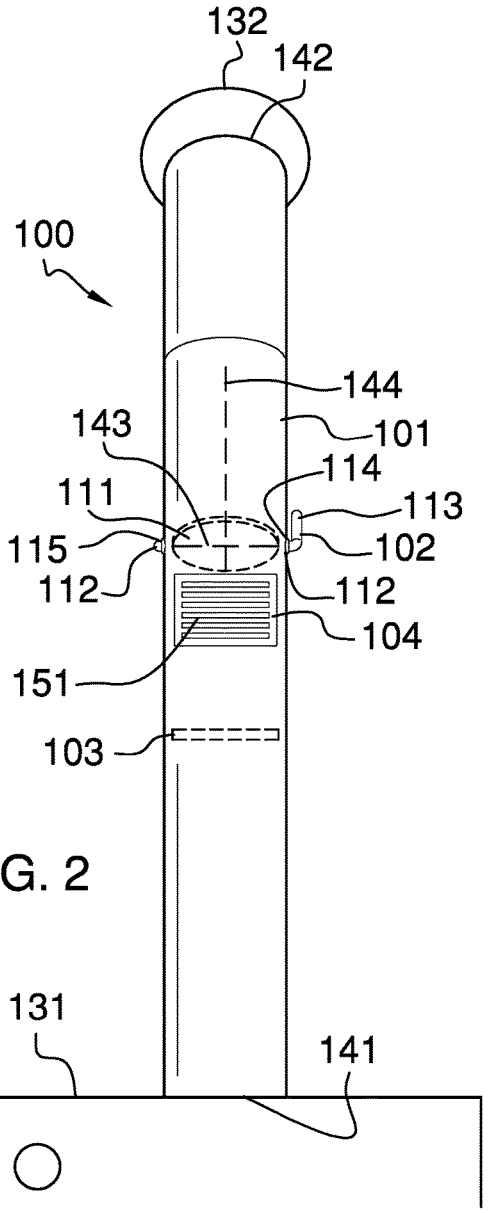
FIG. 2 is a front view of an embodiment of the disclosure.
Figure 3:
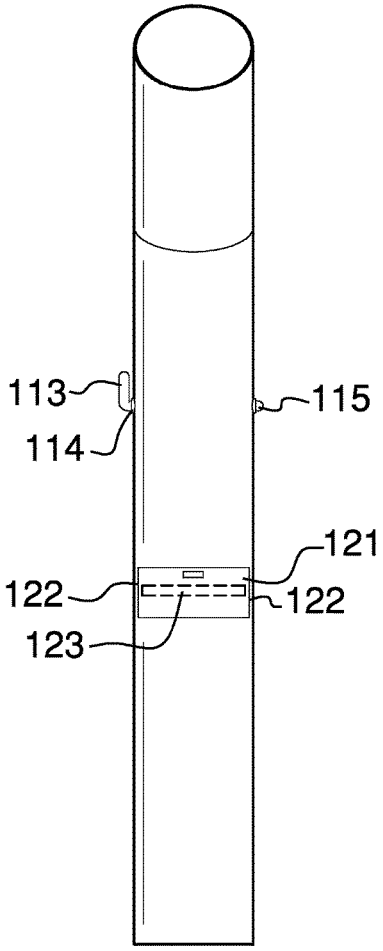
FIG. 3 is a back view of an embodiment of the disclosure.
Figure 4:
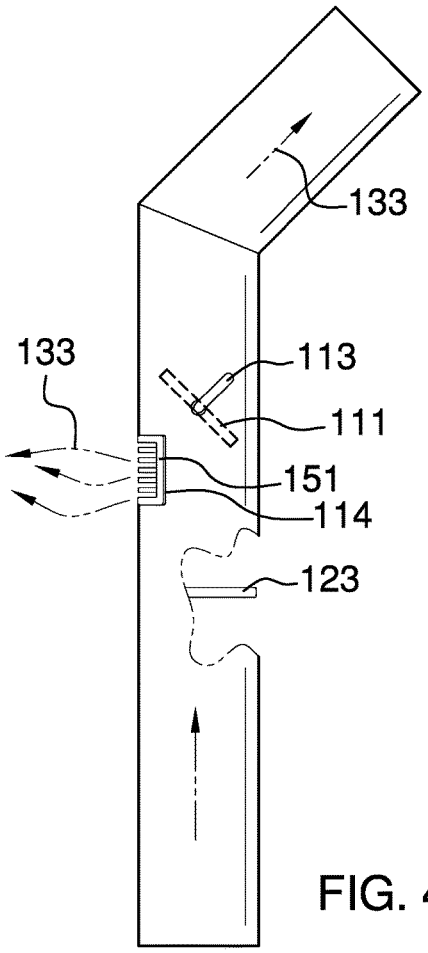
FIG. 4 is a side view of an embodiment of the disclosure.

As shown most clearly in FIG. 2 the first pivot 114 and the second pivot 115 attach the baffle 111 to the master duct 101 such that: 1) the first pivot 114 and the second pivot 115 create a center of rotation 143 around which the baffle 111 can rotate; 2) the center of rotation 143 runs through the center of the baffle 111; 3) the center of rotation 143 intersects perpendicularly through the center axis 144 of the master tube; 4) the center axis 144 is aligned with the center of the baffle 111; and, 5) the baffle 111 can be rotated through an arc of at least 90 degrees such that the baffle 111 will create the open mode and the closed mode of the damper 102 as previously described. The first pivot 114 is fabricated such that a portion of the first pivot 114 projects through the sidewall of the master duct 101 such that a handle 113 can be formed or attached. The handle 113 is used to rotate the baffle 111.

Located in the sidewall of the master duct 101 between the first end 141 and the damper 102 is the vent 104. The vent 104 is an opening that allows the discharged exhaust air 133 from the dryer 131 to escape through the vent 104 when the baffle 111 is in a closed mode. The vent 104 is a commercially available vent that further comprises a plurality of louvers 151 that allow the vent 104 to be closed when the discharged exhaust air 133 is not desired within the building.

The filter assembly 103 is located between the vent 104 and the first end 141 of the master duct 101. The filter assembly 103 is a mechanical particulate filter that removes particulates from the discharged exhaust air 133. The filter assembly 103 further comprises a panel 121, a filter mount 122 and an air filter 123. The air filter 123 is a commercially available particulate filter through which the discharged exhaust air 133 will flow. The panel 121 is the structure into which the air filter 123 is placed such that the air filter 123 will receive and filter the discharged exhaust air 133. The filter mount 122 is commercially available hardware that is used to attach the panel 121 to the sidewalls of the master duct 101. The filter assembly 103 is designed such that the air filter 123 can be regularly and conveniently replaced.

To use the invention 100, the handle 113 is turned into a position that places the damper 102 in the closed mode. The louvers 151 of the vent 104 are placed in the open position. In this configuration, the discharged exhaust air 133 will flow into the building. To route the discharged exhaust air 133 to the exhaust vent 132, the louvers 151 of the vent 104 are placed in the closed position and the damper 102 is placed in the open mode.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; or, 4) the point, pivot, or axis around which something revolves.

Center Axis: As used in this disclosure, the center axis is the axis of a cylinder or tube like structure.

Center of Rotation: As used in this disclosure, the center of rotation is the point of a rotating plane that does not move with the rotation of the plane or a line within a rotating object that does not move with the rotation of the object.

Duct: As used in this disclosure, a duct is a tube, pipe, canal or channel through which air is conducted or conveyed.

Diameter: As used in this disclosure, a diameter of an object is a straight line segment that passes through the center of an object. The line segment of the diameter is terminated at the perimeter or boundary of the object through which the line segment of the diameter runs.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Tube: As used in this disclosure, a tube is a hollow device that is used for transporting liquids and gasses. In this disclosure, the terms inner diameter of a pipe and outer diameter are used as they would be used by those skilled in the plumbing arts.

Vent: As used in this disclosure, a vent is an opening in the ductwork that allows air to escape.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An item of ductwork comprising:

a master duct, a damper, a filter assembly, and a vent;

wherein the damper, the filter assembly, and vent are attached to the master duct;

wherein the item of ductwork is adapted for use with a dryer;

wherein the dryer is located in a building;

wherein the dryer discharges exhaust air;

wherein the item of duct work routes the discharged exhaust air to an exhaust vent or into an interior of the building;

wherein the master duct is a tube;

wherein the master duct is further defined with a first end, a second end, a center axis; and a sidewall;

wherein the first end of the master duct is attached to the dryer;

wherein the master duct receives discharged exhaust air from the dryer;

wherein the second end of the master duct is attached to the exhaust vent;

wherein the master duct transports the discharged exhaust air to its final destination;

wherein the damper is a valve that is mounted within the master duct;

wherein the damper is further defined with an open mode and a closed mode;

wherein when the damper is in the open mode the discharged exhaust air flows unimpeded from the first end of the master duct to the second end of the master duct;

wherein when the damper is in a closed mode, the discharged exhaust air is diverted to the vent;

wherein the damper further comprises a baffle, a baffle mount, and a handle;

wherein the baffle is a plate that is mounted within the master duct;

wherein the baffle mount attaches the baffle to the master duct;

wherein the handle is attached to the baffle mount;

wherein the position of the baffle is adjustable;

wherein the handle adjusts the position of the baffle;

wherein the baffle directs a flow of the discharged exhaust air to the exhaust vent or into the interior of the building;

wherein the baffle mount comprises a first pivot and a second pivot;

wherein the first pivot connects the baffle to the sidewall of the master duct;

wherein the second pivot connects the baffle to the sidewall of the master duct;

wherein the baffle mount attaches the baffle to the master duct such that the first pivot and the second pivot create a center of rotation around which the baffle can rotate;

wherein the baffle mount attaches the baffle to the master duct such that the center of rotation runs through a center of the baffle;

wherein the baffle mount attaches the baffle to the master duct such that the center of rotation intersects perpendicularly through a center axis of the master duct.

2. The item of ductwork according to claim 1 wherein the baffle mount attaches the baffle to the master duct such that the center axis is aligned with the center of the baffle.

3. The item of ductwork according to claim 2 wherein the baffle mount attaches the baffle to the master duct such that the baffle can be rotated through an arc of at least 90 degrees.

4. The item of ductwork according to claim 3 wherein an angle of arc of the baffle determines whether the damper is in a mode selected from the group consisting of the open mode or the closed mode.

5. The item of ductwork according to claim 4 wherein the first pivot is fabricated such that a portion of the first pivot projects through the sidewall of the master duct;

wherein the first pivot further comprises a handle;

wherein the handle rotates the baffle.

6. The item of ductwork according to claim 5 wherein the vent is located in the in the sidewall of the master duct;

wherein the vent releases discharged exhaust air into the building;

wherein the vent is located between the first end and the damper;

wherein the vent is an opening that releases the discharged exhaust air the vent into the building;

wherein the vent further comprises a plurality of louvers.

7. The item of ductwork according to claim 6 wherein the filter assembly is located between the vent and the first end of the master duct.

8. The item of ductwork according to claim 7 wherein the filter assembly comprises a panel, a filter mount and an air filter;

wherein the air filter is mounted in the panel;

wherein the filter mount attaches the panel to the master duct.

9. The item of ductwork according to claim 8 wherein the air filter is positioned such that the discharged exhaust air will flow through the air filter.

10. The item of ductwork according to claim 9 wherein the air filter is a particulate filter.

11. The item of ductwork according to claim 10 wherein the air filter is removably attached to the panel.

* * * * *